US009650119B2

(12) United States Patent
Morikami et al.

(10) Patent No.: US 9,650,119 B2
(45) Date of Patent: May 16, 2017

(54) MOVING CENTER ESTIMATION METHOD AND SYSTEM FOR BOAT

(71) Applicant: SUZUKI MOTOR CORPORATION, Hamamatsu-shi, Shizuoka (JP)

(72) Inventors: Tadaaki Morikami, Hamamatsu (JP); Masaya Nishio, Hamamatsu (JP); Takanori Miyoshi, Toyohashi (JP); Toyohiro Yumiba, Toyohashi (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 0 days.

(21) Appl. No.: 14/433,753

(22) PCT Filed: Jul. 23, 2013

(86) PCT No.: PCT/JP2013/069913
§ 371 (c)(1),
(2) Date: Apr. 6, 2015

(87) PCT Pub. No.: WO2014/057722
PCT Pub. Date: Apr. 17, 2014

(65) Prior Publication Data

US 2015/0266557 A1 Sep. 24, 2015

(30) Foreign Application Priority Data

Oct. 11, 2012 (JP) ..... 2012-226263

(51) Int. Cl.
*B63H 25/42* (2006.01)
*B63H 25/24* (2006.01)
(Continued)

(52) U.S. Cl.
CPC ..... *B63H 21/22* (2013.01); *B63H 25/24* (2013.01); *B63H 25/42* (2013.01); *B63H 2020/003* (2013.01); *B63J 2099/008* (2013.01)

(58) Field of Classification Search
CPC ..... B63H 21/22; B63H 25/24; B63H 25/42; B63H 2020/003; B63J 2099/008
See application file for complete search history.

(56) References Cited

U.S. PATENT DOCUMENTS

2005/0092225 A1* 5/2005 Kaji ..... B63H 25/42 114/144 R
2007/0017426 A1 1/2007 Kaji et al.
2011/0153125 A1* 6/2011 Arbuckle ..... B63B 39/00 701/21

FOREIGN PATENT DOCUMENTS

CN 1636825 A 7/2005
EP 2338785 A2 6/2011
(Continued)

OTHER PUBLICATIONS

International Search Report dated Oct. 22, 2013, which issued during prosecution of International Application No. PCT/JP2013/069913, which corresponds to the present application.
(Continued)

*Primary Examiner* — Aaron L Troost
(74) *Attorney, Agent, or Firm* — Troutman Sanders LLP

(57) ABSTRACT

In a moving center estimation method, a provisional moving center is set at a predetermined position in a neighborhood of an actual moving center of a hull. A sample thrust having a predetermined magnitude and direction is applied to the provisional moving center by driving the outboard motor, and a magnitude and direction of an angular acceleration generated in the hull by application of the sample thrust is detected. The magnitude of the angular acceleration is compared with a predetermined threshold value, and a position of the provisional moving center is changed and set so that the angular acceleration may converge in the threshold value, when the angular acceleration is larger than the threshold value.

5 Claims, 4 Drawing Sheets

(51) Int. Cl.

| | |
|---|---|
| ***B63H 21/22*** | (2006.01) |
| *B63H 20/00* | (2006.01) |
| *B63J 99/00* | (2009.01) |

(56) References Cited

FOREIGN PATENT DOCUMENTS

| | | |
|---|---|---|
| JP | H01-285486 | 11/1989 |
| JP | 2005-145438 | 6/2005 |
| WO | 2007/030040 A1 | 3/2007 |

OTHER PUBLICATIONS

English Translation of the International Preliminary Report on Patentability, having a mailing date of Apr. 23, 2015, issued in corresponding International Application Serial No. PCT/JP2013/069913.

Chinese Office Action dated May 4, 2016, issued in the corresponding Chinese Application No. 201380053260.9.

Extended European Search Report dated Jul. 22, 2016 of the corresponding EPC patent application No. 13844759.4.

* cited by examiner

CL
Fr
Rr
2
3a
3b
R
F
S
W
L
L/2
L/4
L/8
L/16
M1
M2
P
G
g1
g2
g3
r1
r2

MOVING CENTER ESTIMATION METHOD AND SYSTEM FOR BOAT

CROSS REFERENCE TO RELATED APPLICATIONS

This application is a U.S. National Phase Application under 35 U.S.C. §371 of International Patent Application PCT/JP2013/069913 filed Jul. 23, 2013 which claims priority to Japanese Patent Application 2012-226263 filed Oct. 11, 2012. The International Application was published on Apr. 17, 2014, as International Publication No. WO 2014/057722 under PCT Article 21(2). The entire contents of these applications are hereby incorporated by reference.

TECHNICAL FIELD

The present invention relates to a moving center estimation method and system of estimating a moving center of a boat equipped with an outboard motor in particular.

BACKGROUND ART

A steering-by-wire method has been gradually deployed in a boat as a boat operating system. This method mainly uses a motor pump and relies on hydraulic control thereof.

On the other hand, in order to improve operationality of leaving and getting to the shore, it is suggested to equip a boat with two or more propulsion devices and to control behavior of the boat by output control and rudder angle control of each thereof (for example, see Patent Literature 1).

CITATION LIST

Patent Literature

Patent Literature 1: Japanese Laid-open Patent Publication No. 01-285486

SUMMARY OF INVENTION

Technical Problem

Incidentally, when a propulsion device is an outboard motor, it is an important point in boat operation how near to a moving center of a boat to make output directions of two outboard motors approximate. However, conventionally, a rudder angle of an outboard motor is determined by finding a moving center in advance. Therefore, a boat operation system has a one-to-one relation with the boat in question, that is, is only for that boat and does not have redundancy. Further, determination of the moving center requires considerable labor and time.

In view of the above circumstances, an object of the present invention is to provide a moving center estimation method and system which are superior in applicability and which estimate a moving center of a boat simply and effectively.

Solution To Problem

A moving center estimation method for boat according to the present invention is a moving center estimation method for boat which estimates a moving center of a boat equipped with a plurality of outboard motors on a stern side of a hull, and the moving center estimation method for boat has: a provisional moving center setting step of setting a provisional moving center at a predetermined position in a neighborhood of an actual moving center of the boat; a sample thrust application step of applying a sample thrust having a predetermined magnitude and direction to the provisional moving center by driving the outboard motor; an angular acceleration detection step of detecting a magnitude and direction of an angular acceleration generated in the boat by application of the sample thrust; an angular acceleration comparison step of comparing the magnitude of the angular acceleration with a predetermined threshold value; and a provisional moving center changing and setting step of changing and setting a position of the provisional moving center so that the angular acceleration may converge in the threshold value, when the angular acceleration is larger than the threshold value.

Further, in the moving center estimation method for boat according to the present invention, the position to be changed of the provisional moving center is calculated by using dichotomy so as to shorten a distance between the actual moving center and the provisional moving center, in the provisional moving center changing and setting step.

Further, in the moving center estimation method for boat according to the present invention, the provisional moving center is set at a position of ¼ an entire length from a stern of the hull and on a boat center line, in the provisional moving center setting step.

Further, in the moving center estimation method for boat according to the present invention, the sample thrust is applied to the provisional moving center in a direction orthogonal to a boat center line, in the sample thrust application step.

Further, a moving center estimation system for boat according to the present invention is a moving center estimation system for boat which is configured, in a boat equipped with an outboard motor on a stern side of a hull, to be able to control shift, throttle, and steering of the outboard motor by an operation of a joystick by a by-wire method via a helm controller and which estimates a moving center of the boat, and the moving center estimation system for boat has: a provisional moving center setting device setting a provisional moving center at a predetermined position in a neighborhood of an actual moving center of the boat; a sample thrust application device applying a sample thrust having a predetermined magnitude and direction to the provisional moving center by driving the outboard motor; an angular acceleration detection device detecting a magnitude and direction of an angular acceleration on a horizontal plane which is generated in the boat by application of the sample thrust; an angular acceleration comparison device comparing the magnitude of the angular acceleration with a predetermined threshold value; and a provisional moving center changing and setting device changing and setting a position of the provisional moving center so that the angular acceleration may converge to the threshold value, when the angular acceleration is larger than the threshold value.

Further, a program according to the present invention is a program to cause a computer to function as each device of the above described moving center estimation system for boat.

Advantageous Effects of Invention

According to the present invention, it is possible to accurately estimate a moving center by performing several times of calibration, and such a calibration operation is able to be performed automatically, which is simple and superior in usability. Further, by using dichotomy in particular, an angular acceleration on a horizontal plane is efficiently made to converge by several times of calibration, and it is possible to surely estimate the moving center.

Further, a dead zone is provided to an estimated value of the moving center, that is, it is unnecessary to determine the moving center as an absolute value, so that a moving center estimation method suitable to a boat is realized. Further, a system of the present invention can be applied by adding on an existing boat and is superior also in practicability.

DESCRIPTION OF EMBODIMENTS

Hereinafter, a preferred embodiment of a moving center estimation method and system for boat according to the present invention will be described based on the drawings.

Figure 1:
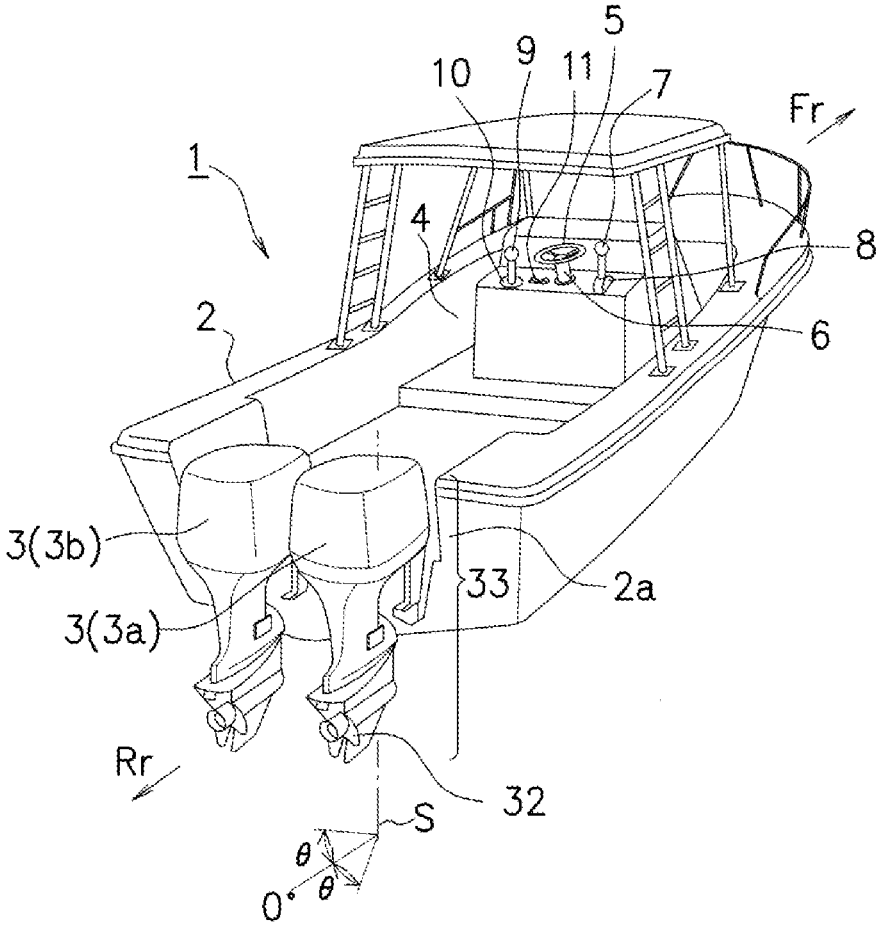
FIG. 1 is a perspective view of a boat according to an embodiment of the present invention, viewed obliquely from behind.

FIG. 1 is a perspective view of a boat 1 as an application example of the present invention, viewed obliquely from behind. First, an entire configuration of the boat 1 will be schematically described by using FIG. 1. Note that the front of a vehicle is indicated by an arrow Fr and the rear of the vehicle is indicated by an arrow R respectively as necessary in the drawings used in the following description including FIG. 1.

As shown in FIG. 1, to a transom positioned in a rear section of a hull 2 of the boat 1, a plurality of outboard motors 3 (here, two outboard motors 3*a*, 3*b*) each equipped with an engine are attached via a bracket device.

An operation cabin 4 is formed on a front side of the hull 2. In the operation cabin 4 are disposed a helm 6 with which a steering wheel 5 is coupled, a remote control box 8 having a remote control lever 7, an omnidirectional operation unit 10 having a joystick 9 as an operating lever, and a changeover switch 11.

A boat operator operates the steering wheel 5 and the remote control lever 7 to operate the boat 1 at normal time, and operates the joystick 9 to operate the boat 1 when desiring meticulous behavior in leaving or getting to the shore. The boat operator performs selection via the changeover switch 11 to be able to change over between an operation using the steering wheel 5 and the remote control lever 7 and an operation using the joystick 9.

Figure 2:
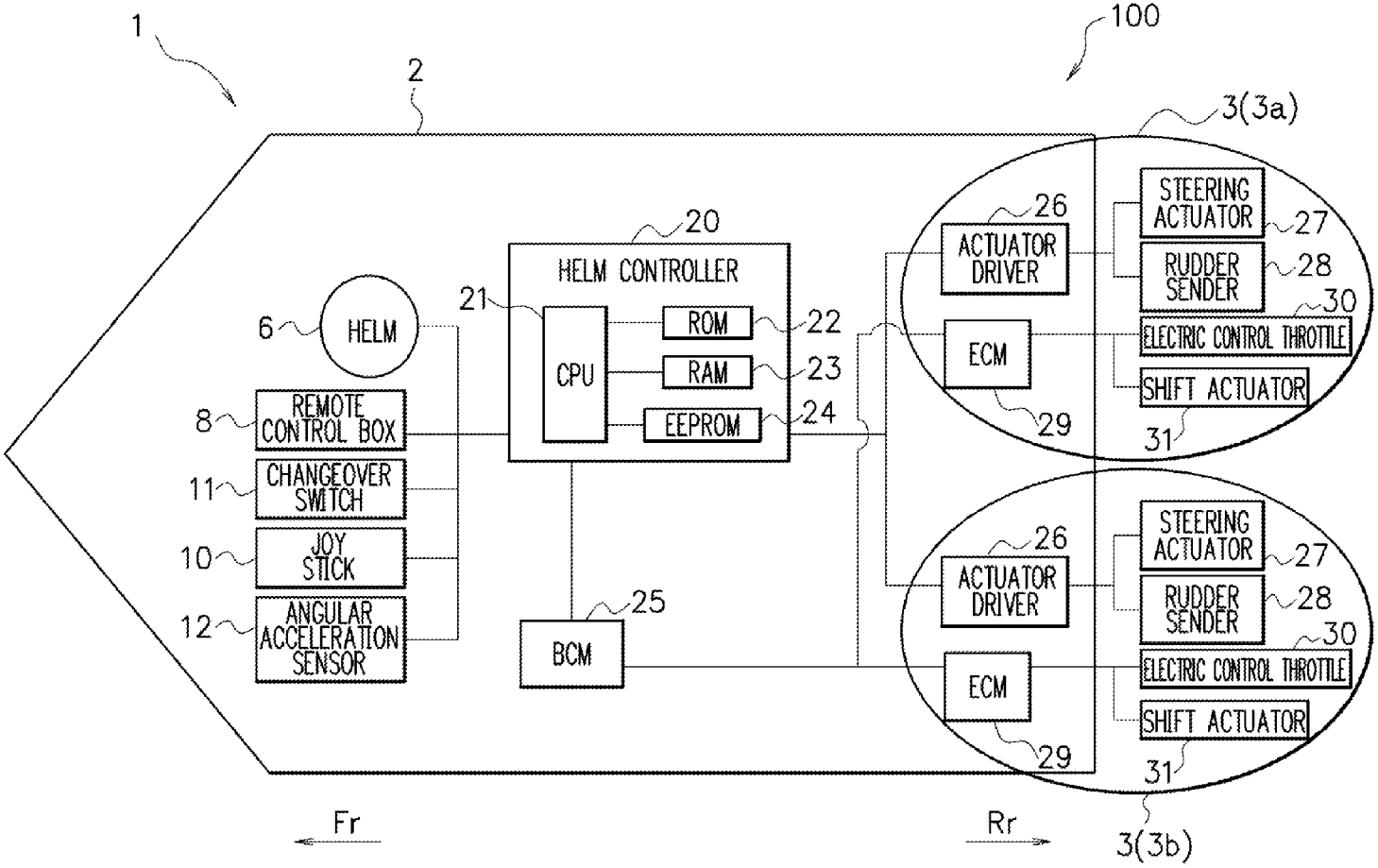
FIG. 2 is a block diagram showing a configuration of a boat operation system for boat according to the present invention.

FIG. 2 is a block diagram showing a configuration of a boat operation system for boat. In FIG. 2, the same components as in FIG. 1 are given the same reference numerals. In a boat operation system 100 of the present embodiment, systems of a shift-by-wire method, a throttle-by-wire method, and a steering-by-wire method are used. In other words, information on the operation of the steering wheel 5, the remote control lever 7, and the joystick 9 is electrically outputted to a helm controller 20 described later and the helm controller 20 electrically controls the outboard motors 3*a*, 3*b* based on the information on the operation, whereby shift, throttle, and steering of the outboard motors 3*a*, 3*b* change.

Hereinafter, a concrete configuration of the boat operation system 100 will be described.

The boat operation system 100 has an angular acceleration sensor 12, a helm controller 20, a BCM 25, and the outboard motors 3*a*, 3*b* in addition to the aforementioned helm 6, remote control box 8, omnidirectional operation unit 10, and changeover switch 11.

The helm 6 has a built-in steering sensor which detects a steering operation angle of the steering wheel 5. The helm 6 outputs information on the detected steering operation angle to the helm controller 20.

The remote control box 8 detects a shift operation position and operation amount when the remote control lever 6 is operated from a neutral position to a front side or a rear side. The remote control box 8 outputs information on the detected shift operation position and operation amount to the helm controller 20.

The omnidirectional operation unit 10 has a built-in sensor which detects an operation position and operation amount when the joystick 9 is operated. The omnidirectional operation unit 10 outputs the information on the detected operation position and operation amount to the helm controller 20.

The changeover switch 11 detects a selected position selected by the boat operator and outputs information on the detected selected position to the helm controller 20. The helm controller 20 enables only either the operation by the steering wheel 5 and the remote control lever 7 or the operation by the joystick 9 and disables the other operation according to the selected position detected by the changeover switch 11.

The angular acceleration sensor 12 is attached to the hull 2, and detects an angular acceleration when the hull 2 pivots in a horizontal direction. The angular acceleration sensor 12 outputs information on the detected angular acceleration to the helm controller 20.

The helm controller 20 functions as a control device which controls the outboard motor 3*a* and the outboard motor 3*b*. More specifically, the helm controller 20 is electrically connected to the aforementioned helm 6, remote control box 8, omnidirectional control unit 10, changeover switch 11, and angular acceleration sensor 12, and electrically connected to the BCM 25, and respective actuator drivers 26 of the outboard motors 3*a*, 3*b*.

The helm controller 20 constitutes what is called a computer including a CPU 21, a ROM 22, a RAM 23, an EEPROM 24, and so on.

The CPU 21 realizes processing in a later-described flowchart by executing a program stored in the ROM 22. The ROM 22 is a non-volatile memory and stores a program executed by the CPU 21, setting values for controlling the outboard motors 3*a*, 3*b*, and so on. The RAM 23 is a volatile memory and temporarily stores information and so on calculated when the CPU 21 controls the outboard motors 3*a*, 3*b*. The EEPROM 24 is a rewritable non-volatile memory and stores information and so on when the CPU 21 controls the outboard motors 3*a*, 3*b*.

The BCM 25 is a boat control module. The BCM 25 is electrically connected to the helm controller 20 and respective ECMs 29 of the outboard motors 3*a*, 3*b*. The BCM 25 transmits instructions from the helm controller 20 to the ECMs 29. The BCM 25 constitutes a computer including a CPU, a ROM, an EEPROM and so on, similarly to the helm controller 20. Note that the steering system 100 can be constituted with the BCM 25 being omitted. In such a case, the helm controller 20 can be directly electrically connected to the respective ECMs 29 of the outboard motors 3*a*, 3*b*.

Next, configurations of the outboard motors 3*a*, 3*b* will be described. The outboard motors 3*a*, 3*b* have almost the same configurations as each other, and the outboard motor 3*a* will be used for explanation here.

The outboard motor 3*a* has the actuator driver 26, a steering actuator 27, a RUDDER SENDER 28, the ECM 29, an electric control type throttle 30, and a shift actuator 31.

The actuator driver 26 is electrically connected to the steering actuator 27 and the RUDDER SENDER 28 and controls the steering actuator 27 and the RUDDER SENDER 28.

The steering actuator 27 changes a steering angle by making the outboard motor 3*a* pivot in response to an instruction from the helm controller 20 via the actuator driver 26. More specifically, as illustrated in FIG. 1, the steering actuator 27 makes a propulsion unit 33 including a propeller 32 pivot to right and left up to predetermined angles θ respectively around a steering axis S (one-dotted chain line).

The RUDDER SENDER 28 detects an actual steering angle of the outboard motor 3*a* and outputs the above to the actuator driver 26.

Therefore, the actuator driver 26 can drive the steering actuator 27 so as to form a steering angle instructed from the helm controller 20 by acquiring information on the actual steering angle detected by the RUDDER SENDER 28. Further, the actuator driver 26 outputs the actual steering angle acquired from the RUDDER SENDER 28 to the helm controller 20.

The ECM 29 is an engine control module. The ECM 29 is electrically connected to the electric control type throttle 30 and the shift actuator 31 and controls the electric control type throttle 30 and the shift actuator 31.

The electric control type throttle 30 changes an opening and closing angle of a throttle valve of the outboard motor 3*a* in response to an instruction from the helm controller 20 via the BCM 25 and the ECM 29. Opening the throttle valve increases an output of the engine of the outboard motor 3*a* to increase a rotation speed of the propeller 32, so that a propulsive force of the outboard motor 3*a* is raised. On the other hand, closing the throttle valve decreases the output of the engine of the outboard motor 3*a* to decrease the rotation speed of the propeller 32, so that the propulsive force of the outboard motor 3*a* is reduced.

The shift actuator 31 changes shift of the outboard motor 3*a* in response to an instruction from the helm controller 20 via the BCM 25 and the ECM 29. For example, when the instruction of changing the shift to a rearward direction is given from the helm controller 20, the shift actuator 31 changes over the shift by changing engagement of gears in the propulsion unit 33 to make a rotation direction of the propeller 32 be a reverse direction of a rotation direction for a forward direction.

Figures 3A, 3B, 3C:
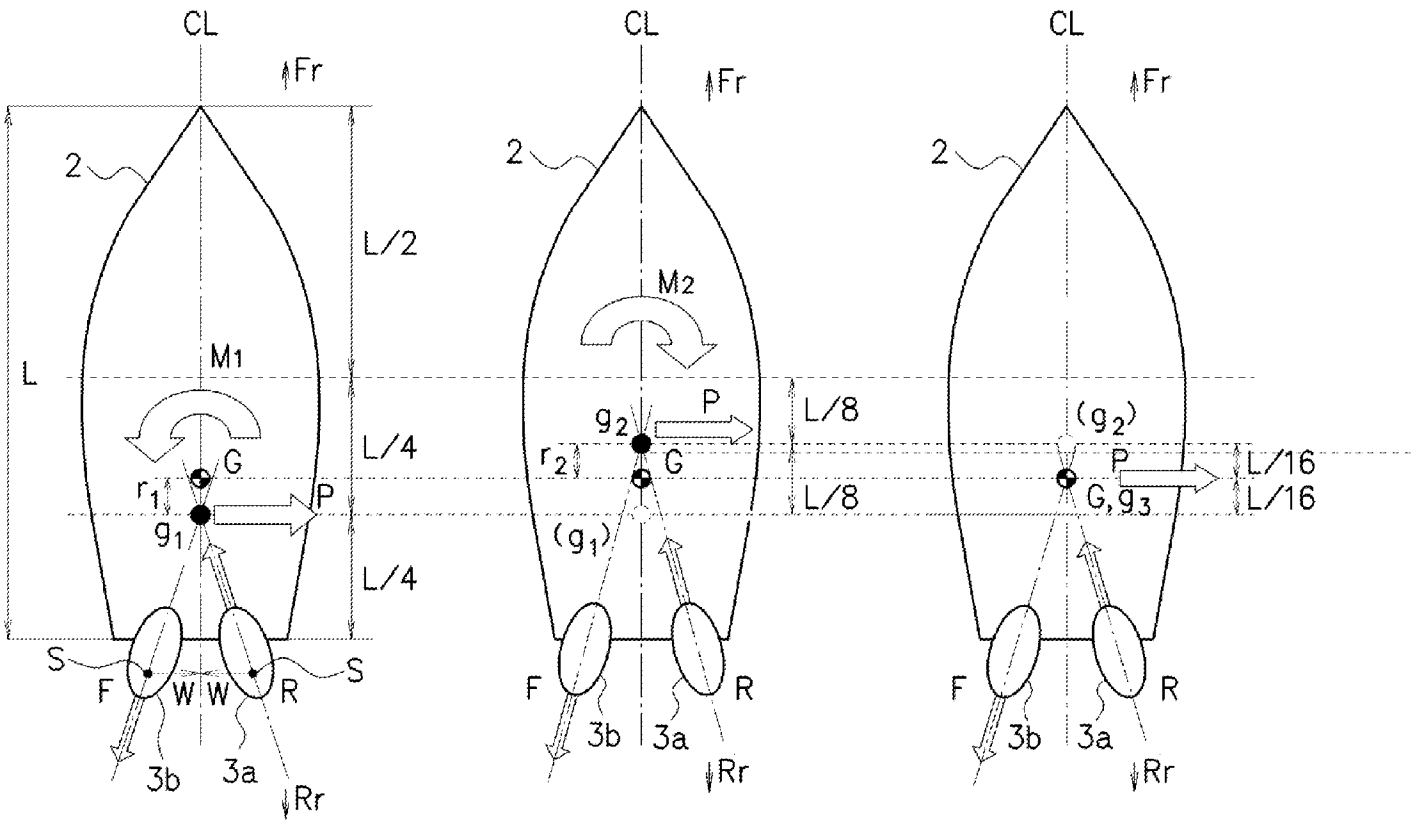
FIGS. 3A, 3B and 3C are schematic diagrams showing typical examples in the present invention in sequence.
Figure 4:
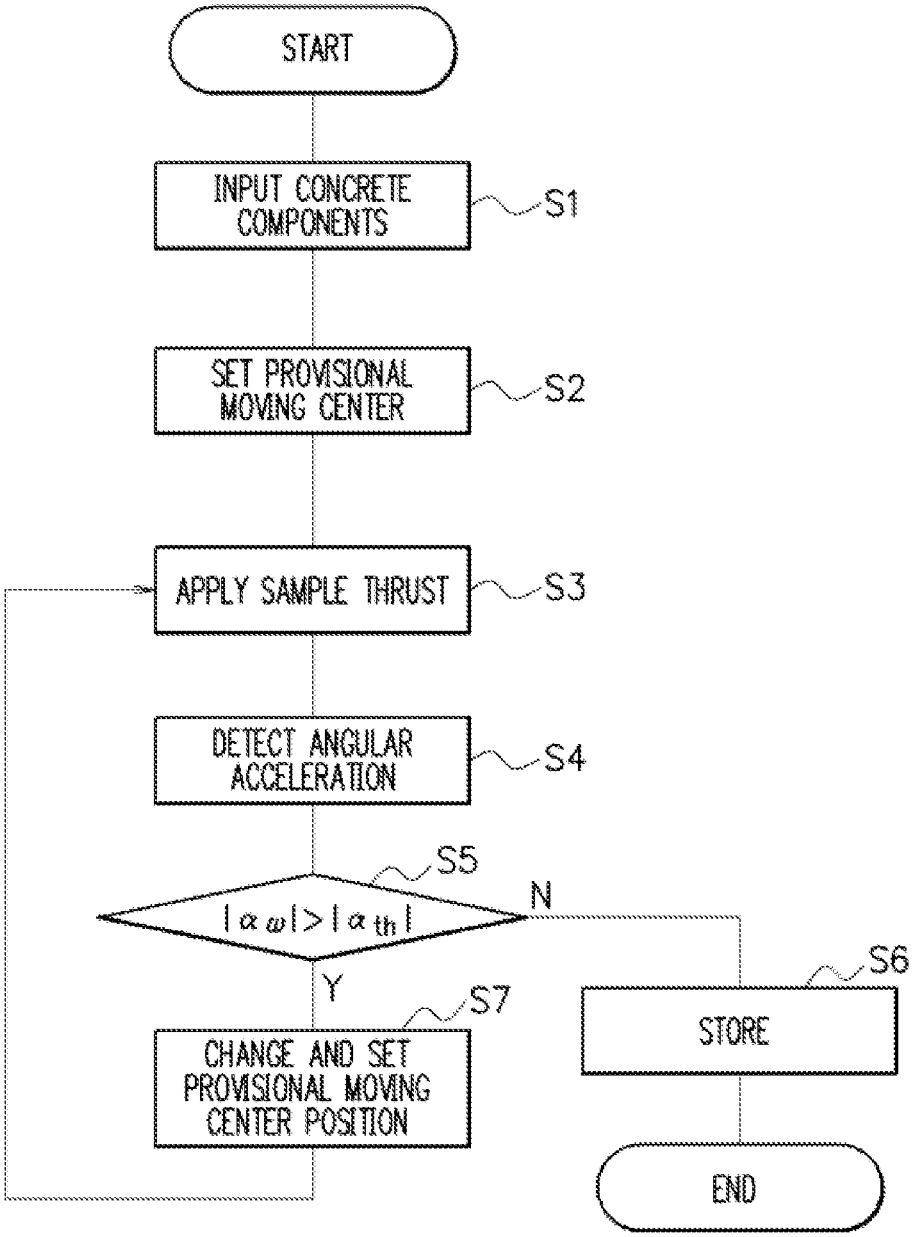
FIG. 4 is a flowchart showing an action according to the typical examples in the present invention.

Next, an example of a moving center estimation method of the present invention will be described by using FIG. 3 and FIG. 4 with reference to FIG. 1 and FIG. 2. FIG. 3 are schematic diagrams showing typical examples in sequence, and FIG. 4 is a flowchart thereof.

First, in a step S1, concrete components related to the boat 1 necessary in executing the present invention are inputted. The concrete components includes an entire length L of the hull 2, a distance W from a boat center line C.L to the steering axis S (see FIG. 1) of the outboard motors 3*a*, 3*b*, and so on, and the entire length L in particular is used for implementing later-described setting of the moving center and dichotomy.

In a step S2, a provisional moving center g is set at a predetermined position in a neighborhood of the actual moving center G of the boat 1. In this case, as shown in FIG. 3A, a provisional moving center $g_1$ (first provisional moving center) is set typically at a position at ¼ of the entire length L from the stern of the hull 2 toward the front and on the boat center line C.L. In the comparatively small-sized boat 1 as in the present example, its center (actual moving center G) is at about ¼ the entire length from the stern as a result of being equipped with the two outboard motors 3*a*, 3*b*, and the provisional moving center $g_1$ is set with the above being a standard. Note that in an illustrated example of FIG. 3A, the provisional moving center $g_1$ is set on a side more near to the stern than the actual moving center G, and a distance therebetween is indicated as $r_1$.

In a step S3, a sample thrust P having a predetermined magnitude and direction is applied to the provisional moving center $g_1$ by driving the outboard motors 3*a*, 3*b* by the operation of the joystick 9. In order to generate a thrust to the boat 1 on the boat center line C.L, sizes (absolute values) of rudder angles θ of the two outboard motors 3*a*, 3*b* are the same. In this example, a rearward thrust R is generated in the outboard motor 3*a* and a forward thrust F is generated in the outboard motor 3*b* respectively so as to point to the provisional moving center $g_1$, and by a resultant force of forces to be given the hull 2 thereby, the sample thrust P is applied in a direction orthogonal to the boat center line C.L, that is, in a lateral direction (in this example, right outward). Rotation or an inertia moment M is generated in the boat 1 based on the sample thrust P.

In a step S4, a magnitude and direction of an angular acceleration αω generated in the boat 1 by application of the sample thrust P is detected. The angular acceleration αω is detected by the angular acceleration sensor 12 and information on the detected angular acceleration αω is outputted to the helm controller 20.

Here, in a case of the distance $r_1$ between the actual moving center G and the provisional moving center $g_1$, a rotational moment $M_1$ centering around the actual moving center G which is given by $M_1=r_1P$ by the application of the sample thrust P is generated. In this example, since the provisional moving center $g_1$ is set on the side nearer to the stern than the actual moving center G, the boat 1 pivots in a counterclockwise direction while moving laterally in a starboard direction. Not only in this case but also similarly in the following, the magnitude and direction of the angular acceleration αω generated in the boat 1 corresponds to a magnitude and direction of rotational moment M, and when the sample thrust P is constant, the magnitude of the angular acceleration αω depends mainly on the distance r between the actual moving center G and the provisional moving center g. Further, it is possible to discriminate by the direction of the angular acceleration αω in which of the forward and the rear of the actual moving center G the provisional moving center g is positioned.

In a step S5, the magnitude of the angular acceleration αω is compared with a predetermined threshold value $\alpha_{th}$. In the moving center estimation method of the present invention, as a result of setting the threshold value $\alpha_{th}$ it suffices that an estimated value converges in what is called a dead zone. Unlikely in a case of a four-wheel vehicle, a moving center position in a case of a boat changes in response to parameters such as magnitude and direction of water flow or wind and further the number of persons on board and so on, and thus it is unnecessary to precisely determine a center position as an absolute value. Note that when the position where the thrust is applied to the moving center is displaced as described above, the boat starts to pivot while moving laterally, and thus occurrence of such displacement can be confirmed based on existence or absence of the angular acceleration.

In a comparison result of the step S5, when the detected angular acceleration $\alpha\omega$ is equal to or smaller than the threshold value $\alpha\omega_{th}$, that value is stored in the RAM 23 in a step S6. In this case, it is estimated that the angular acceleration $\alpha\omega$ of the boat 1 converges, that is, that the provisional moving center g (provisional moving center $g_1$) is the actual moving center G, and the processing is terminated.

On the other hand, when the angular acceleration $\alpha\omega$ is larger than the threshold value $\alpha\omega_{th}$, a position of the provisional moving center g is changed and set so that the angular acceleration $\alpha\omega$ may converge in the threshold value $\alpha\omega_{th}$ in a step S7.

In this case, the position to be changed of the provisional moving center g is calculated by using dichotomy so as to shorten the distance r between the actual moving center G and the provisional moving center g.

More specifically, since the provisional moving center $g_1$ is positioned on the side nearer to the stern than the actual moving center G by equal to or larger than the predetermined value, a position of a provisional moving center $g_2$ (second provisional moving center) is changed further forward and set so as to shorten the distance r between the actual moving center G and the provisional moving center g. In other words, the provisional moving center $g_2$ is set so as to reverse the direction of the angular acceleration $\alpha\omega$ in the counterclockwise direction generated in the boat 1 by the sample thrust P applied to the provisional moving center $g_1$ and to make the direction be a clockwise direction. Note that if the provisional moving center $g_1$ is on a bow side, the provisional moving center $g_2$ is set so as to make the direction be the counterclockwise direction. Since dichotomy is used in the present invention, the provisional moving center $g_2$ is set at a position of ½ of L/4 set for the provisional moving center $g_1$ as shown in FIG. 3B, that is, on the boat center line C.L nearer to the front from the provisional moving center $g_1$ by L/8. In an illustrated example of FIG. 3B, the provisional moving center $g_2$ is set on a side nearer to the bow than the actual moving center G, and a distance therebetween is indicated as $r_2$.

The sample thrust P is applied to the changed provisional moving center $g_2$ by driving the outboard motors 3*a*, 3*b* by the operation of the joystick 9, similarly to in a case of the step S3. By application of the sample thrust P, a rotational moment $M_2=r_2P$ is generated. In this case, since the provisional moving center $g_2$ is set on the side nearer to the bow than the actual moving center G, the boat 1 pivots in the clockwise direction while moving laterally in the starboard direction. The angular acceleration $\alpha\omega$ generated in the boat 1 is detected based on the rotational moment $M_2$, and when the angular acceleration $\alpha\omega$ is larger than the threshold value $\alpha\omega_{th}$, the position of the provisional moving center $g_2$ is similarly further changed and set.

In this case, since the provisional moving center $g_2$ is positioned on the side nearer to the bow than the actual moving center G, the position of the provisional moving center $g_2$ is changed rearward and set so as to shorten the distance r between the actual moving center G and the provisional moving center g. A provisional moving center $g_3$ (third provisional moving center) is set at a position of ½ of L/8 set for the provisional moving center $g_2$ as shown in FIG. 3C, that is, on the boat center line C.L nearer to the rear from the provisional moving center $g_2$ by L/16. As described above, by using dichotomy in the method of the present invention, a position change amount or distance for a provisional moving center g to be set next is decreased by ½, whereby the moving center g can be made converge efficiently and accurately.

Hereinafter, similar processing is repeated, and when the magnitude of the detected angular acceleration $\alpha\omega$ becomes equal to or smaller than the threshold value $\alpha\omega_{th}$, it is estimated that the angular acceleration $\alpha\omega$ of the boat 1 converges, that is, that a provisional moving center $g_n$ at that time is the actual moving center G, and the processing is terminated.

By using the moving center of the boat estimated as above, a boat operation can be performed accurately and smoothly at a time of leaving and getting to the shore and so on thereafter, so that a considerably high effect can be obtained practically.

As described above, according to the present invention, when the moving center is estimated by using the angular acceleration sensor 12, the moving center can be estimated accurately by performing several times of calibration. Further, such a calibration operation is able to be performed automatically only by an operation of turning down the joystick 9 laterally, which is simple and superior in usability.

Further, by using dichotomy, it is possible to make angular acceleration converge efficiently by several times of calibration, and to surely estimate the moving center.

Further, the dead zone is provided to the estimated value of the moving center, and the moving center is estimated by convergence to this dead zone. In other words, it is unnecessary to determine the moving center as an absolute value, so that a moving center estimation method suitable to a boat which is different from a case of a four-wheel vehicle or the like is realized. In this case, the system of the present invention can be applied by what is called adding on to an existing boat and is also superior in practicality.

Further, in implementation of the present invention, since the boat starts to pivot while moving laterally, change of the angular acceleration $\alpha\omega$ can be promptly detected by the angular acceleration sensor 12. For example, compared with a case of a direction angle sensor using earth magnetism or the like, the moving center can be estimated accurately without receiving an influence such as environmental disturbance, so that a high reliability is secured.

Hereinabove, the present invention has been described with various embodiments, but the present invention is not limited to only those embodiments and modification or the like is possible within the scope of the present invention.

With regard to the number of the outboard motors, equipping two or more, for example, three outboard motors is also possible.

The present embodiment can be realized by a computer executing a program. Further, a computer readable storage medium which stores the above-described program and a computer program product such as the above-described program can also be applied as embodiments of the present invention. As the storage medium, it is possible to use a flexible disk, a hard disk, an optical disk, a magnetic-optical disk, a CD-ROM, a magnetic tape, a nonvolatile memory card, a ROM, and so on, for example.

INDUSTRIAL APPLICABILITY

It is possible to provide a moving center estimation method and system which is superior in applicability and which estimates a moving center of a boat simply and effectively.

The invention claimed is:

1. A moving center estimation method for boat which estimates a moving center of a boat equipped with a plurality of outboard motors on a stern side of a hull, the moving center estimation method comprising:

a provisional moving center setter setting a provisional moving center at a standard distance between a reference point on the hull and the provisional moving center and offset from an actual moving center of the boat;

a sample thrust applier (a) applying a sample thrust having a predetermined magnitude and direction to the provisional moving center by driving the outboard motor;

a angular acceleration detector (b) detecting a magnitude and direction of an angular acceleration generated in the boat by application of the sample thrust;

a angular acceleration comparator (c) comparing the magnitude of the angular acceleration with a predetermined threshold value;

(d) if the magnitude of the angular acceleration is greater than the predetermined threshold value, changing a position of the provisional moving center, and then repeating steps (a)-(d);

wherein the position to be changed of the provisional moving center is calculated by using dichotomy to determine a moving distance of the provisional moving center, an initial moving distance being ½ of the standard distance and each subsequent moving distance further reduced by ½, and shortens a distance between the actual moving center and the provisional moving center, in the provisional moving center changing and setting; and if the magnitude of the angular acceleration is not greater than the predetermined threshold value, setting the provisional moving center as the actual moving center.

2. The moving center estimation method for boat according to claim 1, wherein the provisional moving center is set at a position of ¼ an entire length from a stern of the hull and on a boat center line, in the provisional moving center setting.

3. The moving center estimation method for boat according to claim 1, wherein the sample thrust is applied to the provisional moving center in a direction orthogonal to a boat center line, in the sample thrust application.

4. A moving center estimation system for boat which is configured, in a boat equipped with an outboard motor on a stern side of a hull, to be able to control shift, throttle, and steering of the outboard motor by an operation of a joystick by a by-wire method via a helm controller and which estimates a moving center of the boat, the moving center estimation system comprising a processor configured to perform the following:

setting a provisional moving center at a standard distance between a reference point on the hull and the provisional moving center and offset from an actual moving center of the boat;

(a) applying a sample thrust having a predetermined magnitude and direction to the provisional moving center by driving the outboard motor;

(b) detecting a magnitude and direction of an angular acceleration generated in the boat by application of the sample thrust;

(c) comparing the magnitude of me angular acceleration, with a predetermined threshold value;

(d) changing a position of the provisional moving center if the magnitude of the angular acceleration is larger than the predetermined threshold value, and then repeating steps (a)-(d);

wherein the position to be changed of the provisional moving center is caculated by using dichotomy to determine a moving distance of the provisional moving center, an initial moving distance being ½ of the standard distance and each subsequent moving distance further reduced by ½, and shortens a distance between the actual moving center and the provisional moving center, in the provisional moving center changing and setting; and setting the provisional moving center as the actual moving center if the magnitude of the angular acceleration is not larger than the predetermined threshold value.

5. A computer readable non-transitory recording medium with a program for causing a computer to function as each device of a moving center estimation system for boat which is configured, in a boat equipped with an outboard motor on a stern side of a hull, to be able to control shift, throttle, and steering of the outboard motor by an operation of a joystick by a by-wire method via a helm controller and which estimates a moving center of the boat, the moving center estimation system comprising a processor configured to perform the following:

setting a provisional moving center at a standard distance between a reference point on the hull and the provisional moving center and offset from an actual moving center of the boat;

(a) applying a sample thrust having a predetermined magnitude and direction to the provisional moving center by driving the outboard motor;

(b) detecting a magnitude and direction of an angular acceleration generated in the boat by application of the sample thrust;

(c) comparing the magnitude of the angular acceleration with a predetermined threshold value;

(d) changing a position of the provisional moving center if the magnitude of the angular acceleration is larger than the predetermined threshold value, and then repeating steps (a)-(d);

wherein the position to be changed of the provisional moving center is calculated by using dichotomy to determine a moving distance of the provisional moving center, an initial moving distance being ½ of the standard distance and each subsequent moving distance further reduced by ½, and shortens a distance between the actual moving center and the provisional moving center, in the provisional moving center changing and setting; and setting the provisional moving center as the actual moving center if the magnitude of the angular acceleration is not larger than the predetermined threshold value.

* * * * *